US005598135A

United States Patent [19]

Maeda et al.

[11] Patent Number: 5,598,135

[45] Date of Patent: Jan. 28, 1997

[54] TRANSFORMER

[75] Inventors: Eiichi Maeda; Hideyuki Mihara, both of Nagaokakyo, Japan

[73] Assignee: Murata Manufacturing Co., Ltd., Kyoto, Japan

[21] Appl. No.: 948,162

[22] Filed: Sep. 21, 1992

[30] Foreign Application Priority Data

Sep. 20, 1991 [JP] Japan ..... 3-270294

[51] Int. Cl.[6] ..... H01F 5/00

[52] U.S. Cl. ..... 336/200; 336/83

[58] Field of Search ..... 336/200, 232, 336/83

[56] References Cited

U.S. PATENT DOCUMENTS

| | | | |
|---|---|---|---|
| 3,659,240 | 4/1972 | Learned et al. | 336/200 |
| 3,833,872 | 9/1974 | Marcus et al. | 336/83 |
| 4,267,457 | 5/1981 | Nakagawa | 250/522 |
| 4,536,435 | 8/1985 | Utsumi et al. | 428/209 |
| 5,010,314 | 4/1991 | Estrov | 336/200 |
| 5,015,972 | 5/1991 | Cygan et al. | 336/200 |
| 5,029,043 | 7/1991 | Kitahara et al. | 336/200 X |

FOREIGN PATENT DOCUMENTS

| | | | |
|---|---|---|---|
| 0067007 | 4/1983 | Japan | 336/200 |
| 1187909 | 7/1989 | Japan | 336/200 |
| 3283404 | 12/1991 | Japan | 336/200 |
| 0442905 | 2/1992 | Japan | 336/200 |

OTHER PUBLICATIONS

Power Electronics "Planar Magnetics Lower Profile, Improve Converter Efficiency"; May 1989; pp. 16–26.

*Primary Examiner*—Leo P. Picard
*Assistant Examiner*—L. Thomas
*Attorney, Agent, or Firm*—Ostrolenk, Faber, Gerb & Soffen

[57] ABSTRACT

A transformer contains a multi-layered coil block which is formed by laminating and sintering sheets having conduction patterns. External electrodes which are connected to the conduction patterns are formed at the edges of the multi-layered coil block. A hole is made at the center of the multi-layered coil block, and a core is inserted into the hole. For the sheet material, a ceramic material containing glass is used. For the ceramic material, for example, an alumina ceramic material or dielectric ceramic material is used. Also, for the glass, for example, lead glass, borosilicate zinc glass, or borosilicate lead glass is used.

18 Claims, 5 Drawing Sheets

TRANSFORMER

BACKGROUND OF THE INVENTION

1. Field of the Invention

The present invention relates to a transformer, which is formed by laminating sheets with spiral conduction patterns and sintering it.

2. Description of the Prior Art

FIG. 8 is an exploded perspective view showing a usual flat type transformer which has a multi-layered coil block.

A transformer 21 contains an insulating sheet 22 made from ceramic material. At the both sides of the sheet 22, spiral conduction patterns 22*a* and 22*b* are formed, and spiral conduction patterns 22*a* and 22*b* form the primary coil. Similarly, at the both sides of the sheet 23, spiral conduction patterns 23*a* and 23*b* are formed, and spiral conduction patterns 23*a* and 23*b* form the secondary coil. In the center of these sheets 22 and 23, a hole is made to insert a core. And into the holes of sheets 22 and 23, legs 24*a*, 24*a* of the cores 24, 24 are inserted. Lead terminals are connected to the primary coil and the secondary coil, and these lead terminals are used in connecting the coils to the external circuit.

In the transformer 21, a through hole 22*c* is made in the sheet 22, and the conduction pattern 22*a* and the conduction pattern 22*b* are connected through the through hole 22*c*. Thus, the primary coil with necessary windings is formed. The primary coil is connected by soldering etc. to the external terminals (not shown in the drawing). At this time it is easier to connect the primary coil if both ends of the primary coil are on the same surface. In order to accomplish this, the end of the conduction pattern 22*b* is led through a through hole 22*e* to the other side of the sheet 22. Also, the ends of the conduction patterns 22*a* and 22*b* are placed on the same surface of the sheet 22, and are led to the edge of the sheet.

Similarly, conduction patterns 23*a* and 23*b* are connected through a through hole 23*c*. Also, the conduction pattern 23*b* is led through a through hole 23*e* to the other side of the sheet 23. The the ends of the conduction patterns 23*a* and 23*b* are placed on the same surface of the sheet 23 and are led to the edge of the sheet.

Between the sheet 22 and the sheet 23 and on both sides of the sheets 22 and 23, sheets 25 are placed for insulation purposes. By laminating, pressing and sintering the necessary number of sheets, a multi-layered coil block is produced. On the edges of the multi-layered coil block, the ends of the conduction patterns 22*a*, 22*b*, 23*a* and 23*b* are exposed. Lead terminals are connected to these exposed ends of the conduction patterns.

As for the sheet material used in the transformer, for example, ceramic material such as the alumina ceramic material or dielectric ceramic material is used. Also, as the conduction pattern material, for example, conducting paste made from good conductive metal such as Ag or Cu is used.

However, since this type of transformer uses the sheet material made from ceramic material, the high temperature sintering is required in producing the multi-layered coil block. As the result, there are problems with oxidation and evaporation of Ag or Cu in the conduction pattern material. In such circumstances, the direct current resistance increases in the coil, resulting in lowering of the transformer efficiency. Also, since the connection between a transformer and the external circuits is accomplished by lead terminals, the assembly process of attaching terminals is complex. Thus, productivity is low, and the cost of production is high. Furthermore, it limits the miniaturization of a transformer.

SUMMARY OF THE INVENTION

Therefore, the main object of the present invention is to provide a transformer which enables the low temperature sintering to prevent oxidation and evaporation of Ag and Cu, and which can also be miniaturized.

The present invention is a transformer containing a multi-layered coil block which is formed by laminating and sintering sheets with conduction patterns, external electrodes which are formed at the edges of the multi-layered coil block and connected to the conduction patterns, and a core inserted into the multi-layered coil block, wherein the sheets are made from a ceramic material containing glass.

As for the ceramic material, the alumina ceramic material or the dielectric ceramic material is used.

By using the cermaic material containing glass to form a sheet, the low temperature sintering becomes possible. Also, by including glass in the alumina ceramic material or the dielectric ceramic material, the sintered product with the high insulating property, high heat radiating property, and low dielectric constant can be obtained. Furthermore, since the connection between the transformer and the external circuit is accomplished by the external electrodes which are formed at the edge of the multi-layered coil block, lead terminals are no longer necessary. The external electrodes, for example, can be made by painting the conducting paste on the edges of the multi-layered coil block and sintering it.

According to the present invention, because the low temperature sintering is possible, oxidation and evaporation of Ag or Cu in the conduction pattern can be prevented. Thus, the increase in the direct current resistance can be prevented. Also, because the sintered product of sheet material used in the transformer has the high insulating and high heat radiating properties, the insulating capability between the coils is excellent, and the increase in temperature of the transformer can be prevented. Furthermore, because the sintered product of sheet material used in the transformer has a low dielectric constant, the stray capacitance can be lowered and the deterioration of the transformer performance can be prevented. Furthermore, the external electrodes can be formed by painting the conducting paste, etc., and there is no need to attach the lead terminals. Thus, neither leading out the ends of a conducting patterns on the same surface nor soldering is required. Consequently the manufacturing of the transformer can be simplified. Therefore, the productivity of transformers can be increased and the cost of production can be lowered. Also, since no lead terminals are required, transformers can be miniaturized, and they can be surface mounted on the printed circuit board.

The above mentioned object, other objects, special features, situations, and advantages of the present invention will become further more apparent from the following detailed descriptions of the embodiments with the drawings.

DESCRIPTION OF THE PREFERRED EMBODIMENTS

Figure 1:
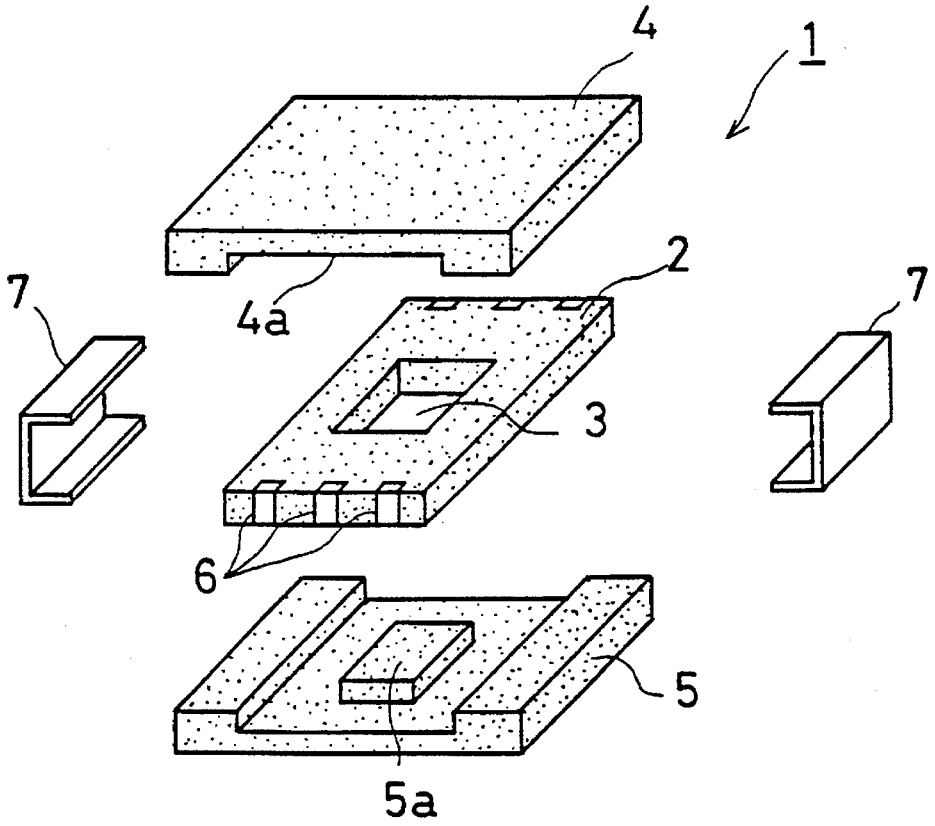
FIG. 1 is an exploded perspective view showing an example of the present invention.

FIG. 1 is an exploded perspective view showing an example of the present invention. A transformer 1 contains a multi-layered coil block 2 with conduction patterns therein. In the center of the multi-layered coil block 2, a hole 3 is made in order to insert a core. At the edges of the multi-layered coil block 2, external electrodes 6 which are connected to the inside conduction patterns are formed. On both sides of the multi-layered coil block 2, for example, ferrite cores 4 and 5 are placed. The ferrite core 4 is formed in a cross sectional E shape with a square pillar leg 4*a* in the middle portion. Similarly, the ferrite core 5 is formed in a cross sectional E shape with a square pillar leg 5*a* in the middle portion. The legs 4*a* and 5*a* of ferrite cores 4 and 5 are inserted into a hole 3 of the multi-layered coil block 2, and the legs 4*a* and 5*a* are connected together in the center portion. These ferrite cores 4 and 5 are fastened by clasps 7.

Figure 3:
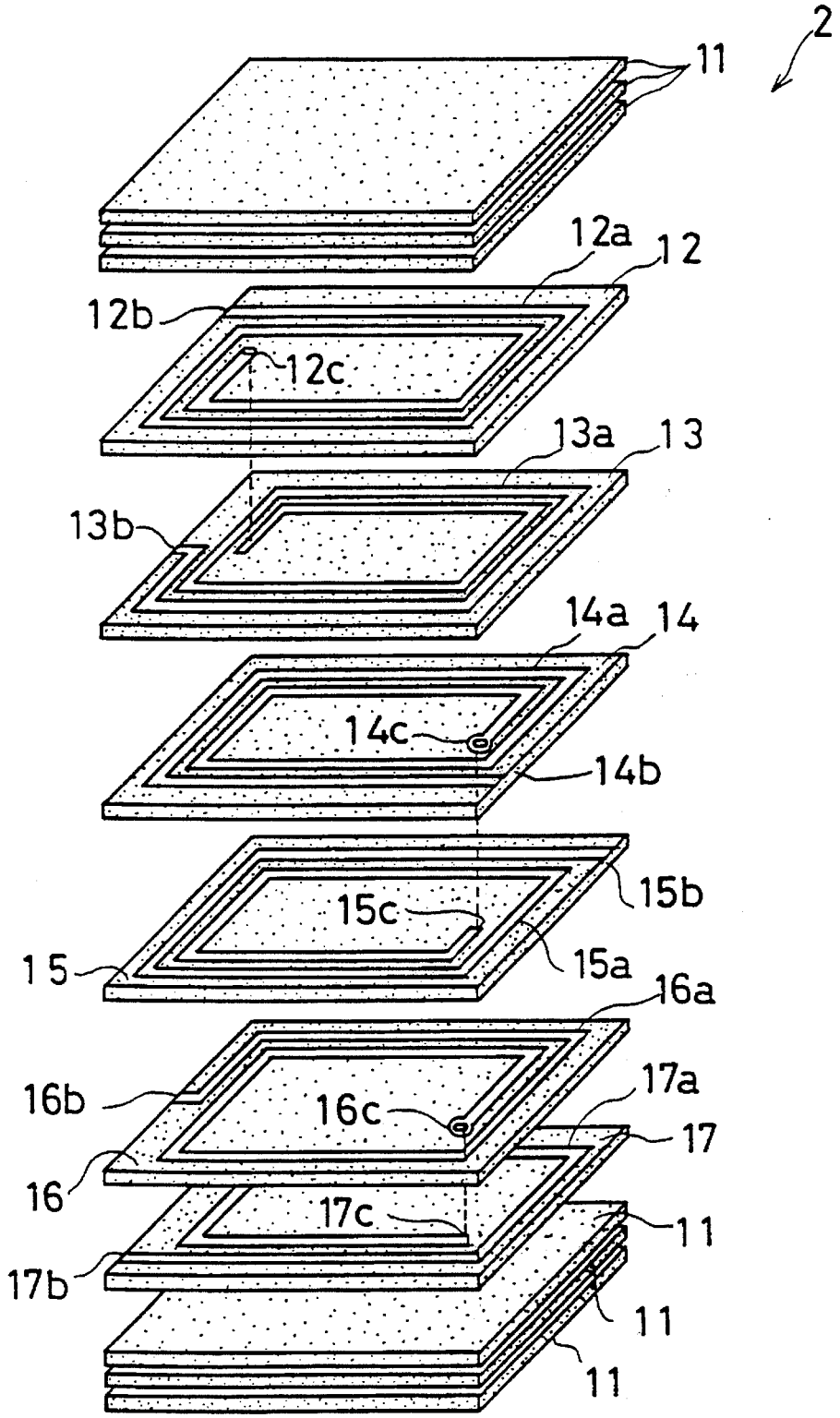
FIG. 3 is an exploded perspective view of the laminating process of the multi-layered coil block in the transformer showing in FIG. 1.

The multi-layered coil block 2, as shown in FIG. 3, contains the sheets 11 with no conduction patterns and the sheets 12, 13, 14, 15, 16 and 17 with conduction patterns. As for the sheet material, the ceramic material containing glass is used. As for the ceramic material, for example, the alumina ceramic material or the dielectric ceramic material is used. Also, as for the glass, for example, lead glass and the borosilicate glass such as borosilicate zinc glass or borosilicate lead glass is used. By mixing these materials, the sheets are formed by the casting sheet method or the extrusion method. As to the amount of glass, because using too small of a quantity of glass would necessitate the high temperature sintering and using too much of a quantity of glass deteriorates its insulation capability, 1–10 weight % of the ceramic material is desirable.

On the surface of the sheet 12, a spiral conduction pattern 12*a* is formed. One end 12*b* of the conduction pattern 12*a* is led near to a tip portion of an edge of the sheet 12, and through hole 12*c* is formed at the other end of the conduction pattern 12*a*. The sheet 13 is placed adjacent to the sheet 12. On the surface of the sheet 13, a spiral conduction pattern 13*a* is formed. One end 13*b* of the conduction pattern 13*a* is led near to the center portion of an edge of the sheet 13, and the other end of the conduction pattern 13*a* is placed in the aligning position to the through hole 12*c*. Also, through the through hole 12*c*, the conduction pattern 12*a* and the conduction pattern 13*a* are connected.

The sheet 14 is placed adjacent to the sheet 13. 0n the surface of the sheet 14, a spiral conduction pattern 14*a* is formed. One end 14*b* of the conduction pattern 14*a* is led to an edge of the sheet 14, and a through hole 14*c* is formed at the other end of the conduction pattern 14*a*. The sheet 15 is placed adjacent to the sheet 14. On the surface of the sheet 15, a spiral conduction pattern 15*a* is formed. One end 15*b* of the conduction pattern 15*a* is led to an edge of the sheet 15, and the other end of the conduction pattern 15*a* is placed in the aligning position to the through hole 14*c*. Also, through the through hole 14*c*, the conduction pattern 14*a* and the conduction pattern 15*a* are connected. The ends 14*b* and 15*b* of the conduction patterns 14*a* and 15*a* are led to the opposite side of the edge where the ends 12*b* and 13*b* of the conduction patterns 12*a* and 13*a* are led out. The ends 14*b* and 15*b* of the conduction patterns 14*a* and 15*a* are led near to the tip portions of an edge of the sheets 14 and 15.

The sheet 16 is placed adjacent to the sheet 15. On the surface of the sheet 16, a spiral conduction pattern 16*a* is formed. One end 16*b* of the conduction pattern 16*a* is led near to the center portion of an edge of the sheet 16, and a through hole 16*c* is formed at the other end of the conduction pattern 16*a*. The sheet 17 is placed-adjacent to the sheet 16. On the surface of the sheet 17, a spiral conduction pattern 17*a* is formed. One end 17*b* of the conduction pattern 17*a* is led near to a tip portion of an edge of the sheet 17, and the other end of the conduction pattern 17*a* is placed in the aligning position to the through hole 16*c*. Also, through the through hole 16*c*, the conduction pattern 16*a* and the conduction pattern 17*a* are connected. The ends 16*b* and 17*b* of the conduction patterns 16*a* and 17*a* are led to the same side of the edge where the conduction patterns 12*a* and 13*a* are led out. The end 17*b* of the conduction pattern 17*a* is led near to the tip portion opposite to the tip portion where the end 12*b* of the conduction pattern 12*a* is led out.

Figure 4A:
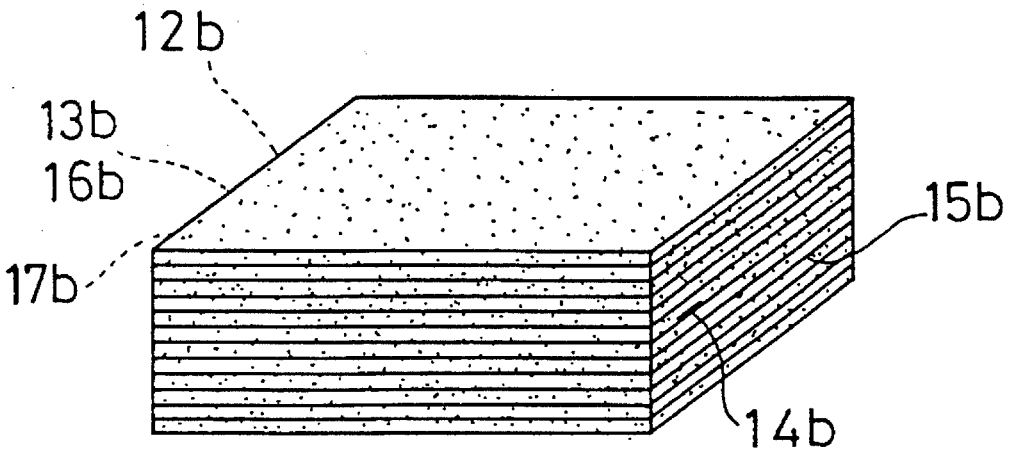
FIG. 4 is a perspective view showing the manufacturing process the multi-layered coil block.
Figure 4B:
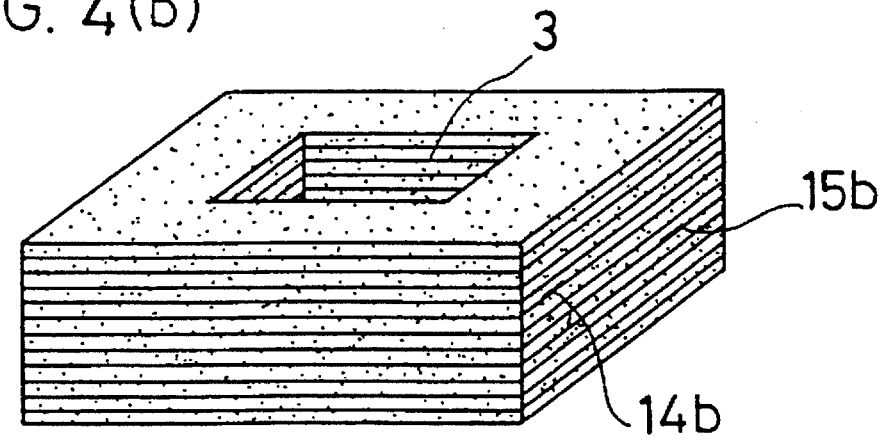
Figure 4C:
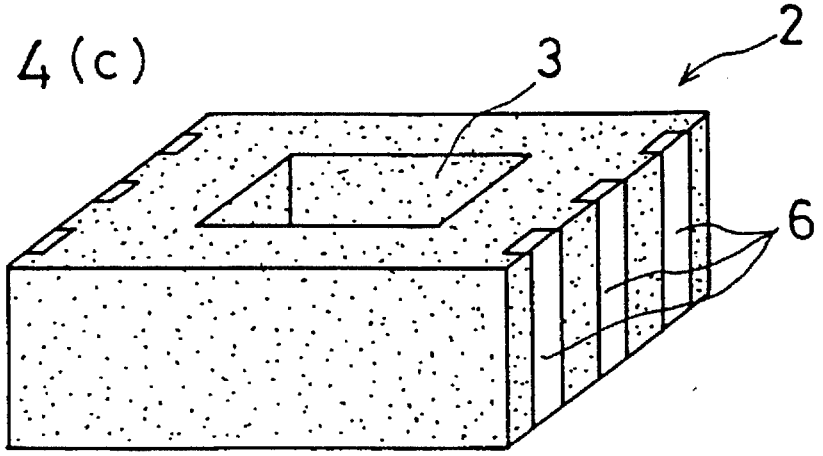
Figure 5:
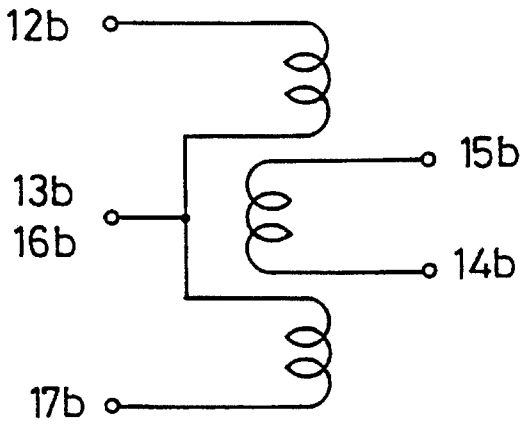
FIG. 5 is an equivalent circuit diagram of the transformer shown in FIG. 1.

On both sides of the sheets with the conduction patterns, sheets 11 without conduction patterns are placed. By laminating and pressing these sheets, the block as shown in FIG. 4(*a*) is formed. Next, as shown in FIG. 4(*b*), a hole 3 is made in the center of the block. After sintering the block at 700°–900° C., as shown in FIG. 4(*c*), by forming plural external electrodes 6, the multi-layered coil block 2 is manufactured. The external electrodes 6 are connected to the exposed parts of the conduction patterns 12*a*, 13*a*, 14*a*, 15*a*, 16*a* and 17*a*. At this time, the ends 13*b* and 16*b* of the conduction patterns 13*a* and 16*a* are connected by the external electrode 6. Therefore, the equivalent circuit of the multi-layered coil block 2 is as shown in FIG. 5.

As shown in FIG. 1, the legs 4*a* and 5*a* of the ferrite cores 4 and 5 are inserted into the hole 3 of the multi-layered coil block 2 and fastened by clasps 7. Thus, the transformer 1 is manufactured.

In the transformer, since the laminated multi-layered coil block is used, it is possible to obtain a thin type transformer. Also, by controlling the number of sheets with the conduction patterns, it is possible to adjust the number of windings of the coils. Furthermore, the ferrite cores can be fastened by clasping, resulting in an easy assembly. Also, Ag or Cu is used as the material for the conduction pattern, the low temperature sintering is possible by using the ceramic material containing glass, and the oxidation and the evaporation of Ag or Cu can be prevented. Therefore, the increase in the direct current resistance of the coils can be prevented and the deterioraion of the transformer efficiency can be prevented.

Furthermore, by using the ceramic material containing glass, the multi-layered coil block of the transformer has the high insulation property and high heat radiating property. For these reasons, the increase in temperature of the transformer can be prevented, and the insulation property between the coils is excellent. Also, since the insulating material in the multi-layered coil block has low dielectric constants, the stray capacitance can be lowered, and the deterioation of the transformer performance can be prevented.

Also, since the external electrodes are formed at the edges of the multi-layered coil block, ends of the conduction patterns need not lead out on the same surface of the sheet as in the case of attaching the lead terminals. Furthermore, since the external electrodes can be formed by painting and sintering the conducting paste, it is relatively simple to form the multi-layered coil block compared to the case of soldering the lead terminals. As is clear, the transformer of the present invention is simple to manufacture, and the manufacturing cost can be reduced. Also, since the lead terminals are not necessary, it is possible to miniaturize the transformers.

Figure 2:
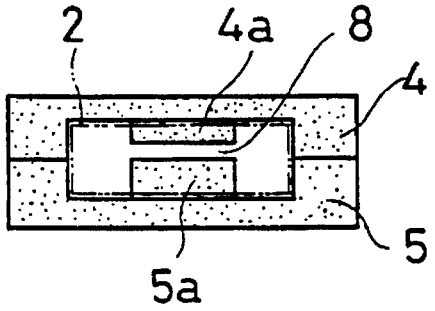
FIG. 2 is an illustrative view showing a varied example of the present invention.

In the above mentioned embodiment, the legs 4*a* and 5*a* of the ferrite cores 4 and 5 are connected together. However, as shown in FIG. 2, a gap 8 may be formed between the legs 4*a* and 5*a*. If the gap 8 is formed in this manner, the ferrite cores 4 and 5 tend to less magnetically saturated, resulting in a large capacity transformer.

Figure 6:
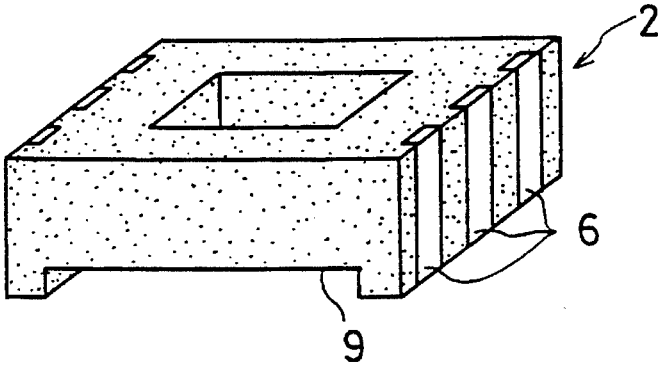
FIG. 6 is a perspective view showing a varied example of the multi-layered coil block.
Figure 7:
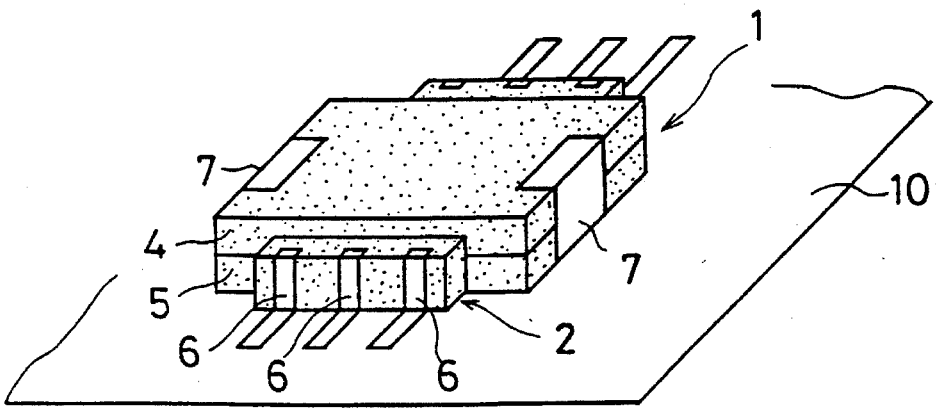
FIG. 7 is a perspective view showing an example of using the transformer of the present invention.
Figure 8:
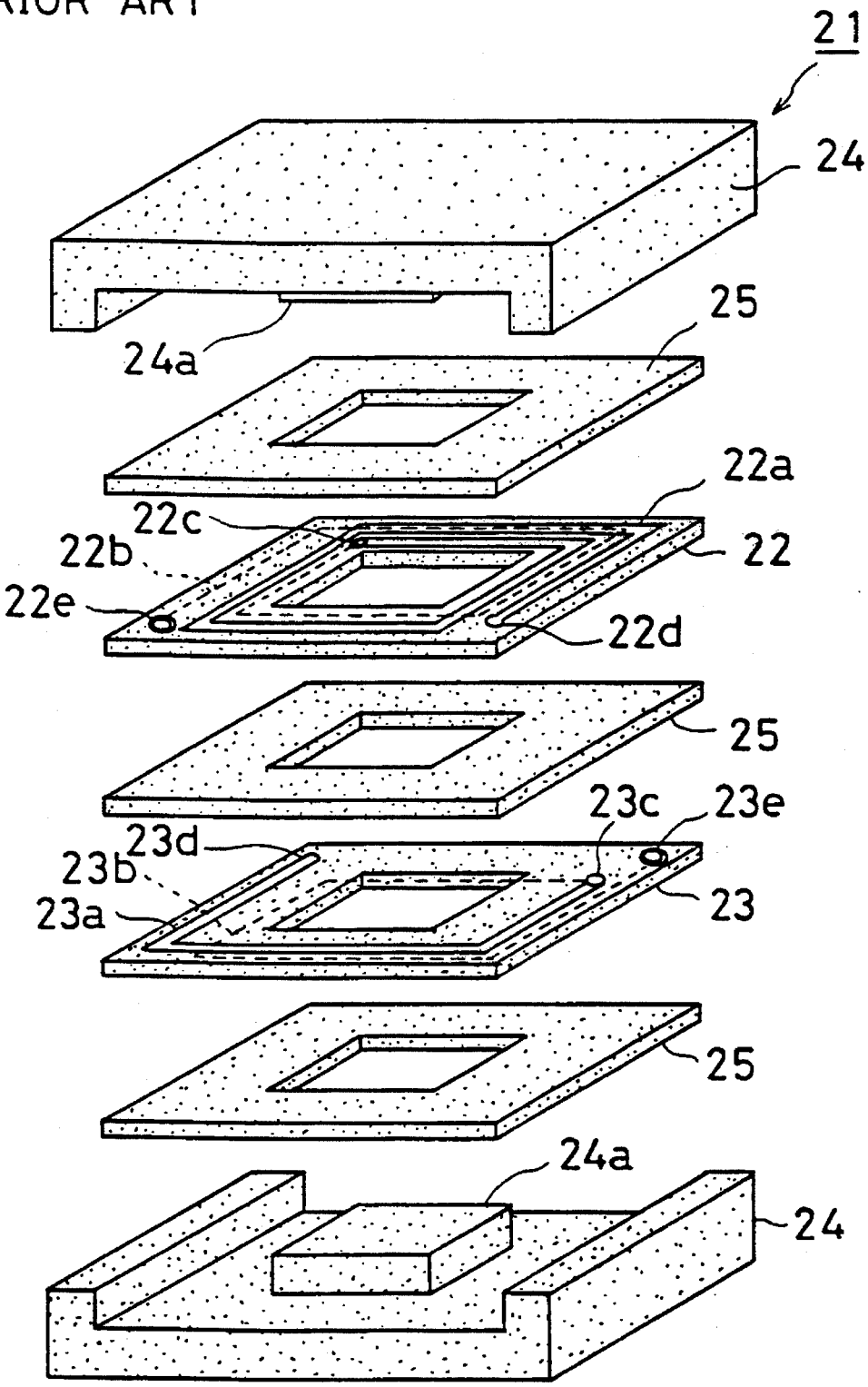
FIG. 8 PRIOR ART
FIG. 8 is an exploded perspective view showing a prior art transformer which provides the background of the invention.

Also, as shown in FIG. 6, a concave recess 9 may be formed. If such a concave recess 9 is formed, when the ferrite cores 4 and 5 are installed, it can be positioned so that the ferrite core 5 and the multi-layered coil block 2 are on the same plane. When such a transformer 1 is mounted to the printed circuit board, as shown in FIG. 7, the external electrodes 6 and the printed circuit board 10 can be closely positioned, thus making the surface mounting of transformers easy.

In the embodiment shown in FIG. 1, two ferrite cores having the cross sectional E shape with square pillared legs are used, but it is acceptable to use the cores having a round column shaped legs. Furthermore, for the cross sectional shape of the ferrite core, it is acceptable to use not only E shape, but also to use E and I shapes in combination. Of course, in this case, it is also acceptable to use square pillars or round columns as the leg shape for the E shaped ferrite core.

Also, for the manufacturing method of the multi-layered coil block, a hole can be made after laminating the sheets and sintering the block, or by laminating the pre-holed sheets and sintering them afterward. Furthermore, as an example of production methods for a conduction patterns, the method of painting or printing of the conducting paste can be used, or the method of plating or sputtering can be used to form the conduction patterns. Furthermore, in order to incorporate glass into the sheet material, glass can be painted on the sheet, not limited to mixing into the sheet material prior to the sintering.

This invention is explained in detail and shown by the drawings, but this is obvious that it is not to be construed as the limit of this invention, the spirit and the coverage of this invention is only limited by the statement of the attached claims.

What is claimed is:

1. A transformer comprising:

a) a multi-layered coil block formed by laminating and sintering sheets made from a ceramic material containing glass, at least one of the sheets having conduction patterns located thereon, said multi-layered coil block having an opening and a recess formed therein;

b) external electrodes formed at a periphery of each of the layers of said multi-layered coil block and connected to said conduction patterns; and c) a core inserted into said opening in said multi-layered coil block and located in said recess in said multi-layered coil block such that the multi-layered coil block and the core are contained in a common plane.

2. A transformer according to claim 1, wherein said ceramic material is alumina ceramic material.

3. A transformer according to claim 1, wherein said ceramic material is dielectric ceramic material.

4. A transformer according to claim 1, wherein said glass is selected from the group consisting of lead glass, borosilicate zinc glass, and borosilicate lead glass.

5. A transformer according to claim 2, wherein said glass is selected from the group consisting of lead glass, borosilicate zinc glass, and borosilicate lead glass.

6. A transformer according to claim 3, wherein said glass is selected from the group consisting of lead glass, borosilicate zinc glass, and borosilicate lead glass.

7. A transformer according to claim 1, wherein a gap is formed in said core.

8. A transformer according to claim 2, wherein a gap is formed in said core.

9. A transformer according to claim 3, wherein a gap is formed in said core.

10. A transformer according to claim 4, wherein a gap is formed in said core.

11. A transformer according to claim 5, wherein a gap is formed in said core.

12. A transformer according to claim 6, wherein a gap is formed in said core.

13. A transformer according to claim 1, wherein the multi-layered coil block further includes a plurality of sheets having no conduction patterns located thereon, the plurality of sheets having conduction patterns being located between the plurality of sheets having no conduction patterns.

14. The transformer of claim 1, further comprising a plurality of connecting members for fastening the multi-layered coil block and the core.

15. The transformer of claim 1, wherein the core includes at least two substantially E-shaped members made of ferrite, the at least two substantially E-shaped members surrounding the multi-layered coil block to form a closed magnetic circuit structure.

16. The transformer of claim 15, wherein each of the at least two substantially E-shaped members includes at least one leg.

17. The transformer of claim 16, wherein the at least one leg of one of the two substantially E-shaped members contacts the at least one leg of the other of the two substantially E-shaped members when the core is inserted in the multi-layered coil block.

18. The transformer of claim 16, wherein the at least one leg of one of the two substantially E-shaped members is spaced from the at least one leg of the other of the substantially E-shaped members to form a gap between the two substantially E-shaped members when the core is inserted in the multi-layered coil block.

* * * * *